United States Patent [19]

Colecchi

[11] 4,147,439

[45] Apr. 3, 1979

[54] RIBBON CARTRIDGE WITH IMPROVED RIBBON TENSIONING AND LOCKING

[75] Inventor: Paul Colecchi, Des Plaines, Ill.

[73] Assignee: A. B. Dick Company, Chicago, Ill.

[21] Appl. No.: 830,635

[22] Filed: Sep. 6, 1977

[51] Int. Cl.[2] ..... B41J 33/14

[52] U.S. Cl. ..... 400/208; 400/234

[58] Field of Search ..... 197/151; 242/75, 75.2, 242/75.3; 400/208

[56] References Cited

U.S. PATENT DOCUMENTS

| | | | |
|---|---|---|---|
| 3,356,202 | 12/1967 | Goff | 197/151 |
| 3,974,906 | 8/1976 | Lee et al. | 197/151 X |
| 4,010,839 | 3/1977 | Guerrini et al. | 197/151 |
| 4,013,160 | 3/1977 | Colecchi et al. | 197/151 |
| 4,026,492 | 5/1977 | Kern | 242/75.2 |

FOREIGN PATENT DOCUMENTS

| | | | |
|---|---|---|---|
| 2632146 | 2/1977 | Fed. Rep. of Germany | 197/151 |

OTHER PUBLICATIONS

IBM Technical Disclosure Bulletin, "Ribbon Cartridge with Brake," Arena et al., vol. 10, No. 4, Sep. 1967, pp. 484–485

Xerox Disclosure Journal, "Ribbon Feed Rolls," Plaza, vol. 1, No. 2, Feb. 1976, pp. 43–44.

Xerox Disclosure Journal, "Ribbon Cartridge with Foam Drag Element," Trezise et al., vol. 1, No. 2, Feb. 1976, pp. 47–48.

Xerox Disclosure Journal, "Constant Ribbon Tension Device," Frechette, vol. 1, No. 7, Jul. 1976, p. 37.

Xerox Disclosure Journal, "Ribbon Advance Mechanism," Mikes, vol. 2, No. 4, Jul./Aug. 1977, p. 47.

*Primary Examiner*—Ernest T. Wright, Jr.

*Attorney, Agent, or Firm*—Peter S. Lucyshyn

[57] ABSTRACT

A ribbon cartridge for use in a typewriter and/or printer which cartridge has a supply of ribbon which is fed from within the cartridge across a gap where it is used by a typing or printing mechanism and returned to a driven take-up area, is disclosed, which cartridge includes an improved tensioning and locking apparatus, comprising a mechanically biased movable member positioned between the ribbon supply and its outlet, so as to bear against the ribbon, which member automatically takes up small overruns of ribbon from a supply and releasably locks the ribbon by means of friction contact when large overruns occur during use.

2 Claims, 3 Drawing Figures

RIBBON CARTRIDGE WITH IMPROVED RIBBON TENSIONING AND LOCKING

FIELD OF THE INVENTION

The invention relates generally to ribbon cartridges for use in typewriters and/or printers employed in word processors, line printers, and the like, and is more particularly related to improved ribbon tensioning and locking of such cartridges.

BACKGROUND OF THE INVENTION

Ribbon cartridges containing inked ribbons for use in powered typewriters and the like, have gained wide acceptance because of the ease of installing such cartridges and because of their inherent cleanliness. Often, such ribbons are of the single pass type, i.e., are not reuseable, wherein the cartridge is, after use, discarded. To manufacture such disposable cartridges which reliably serve their purpose at an economical price is a challenge. With the emergence of higher and still higher speed typewriters/printers, the physical demands made on such cartridges are increasing and the problem of making an economical and reliable cartridge is compounded.

Among the problems encountered in ribbon cartridges is that of maintaining the span of ribbon external to the cartridge at a desired length. If too much ribbon were present, it could become ensnarled with the typing/printing mechanism. To prevent this from happening, provision for stopping or braking both the supply and takeup must be provided. One advantageous method of achieving this is described in U.S. Pat. No. 4,013,160, assigned to A. B. Dick Company, the assignee of the present invention, which patent issued on Mar. 22, 1977, in the names of Paul S. Colecchi, the present inventor, and Cezary Kotecki. The present invention, although capable of a broader application, will be described in the environment of the cartridge described and claimed in that patent.

While constant friction, even aided by spring pressure, may be adequate in some applications, such as shown in U.S. Pat. No. 3,974,906, the increased stress and vibrations resulting occasionally on higher speed powered typewriters and the like, as, for example, result from a full carriage return, make this approach unacceptable. The force necessary to hold the ribbon under these circumstances (which must be overcome to advance it) would require an excessively thick or strong ribbon or would run the danger of breaking or tearing the ribbon.

While mechanical hub rims and lever interlocks, such as shown in U.S. Pat. No. 4,010,839, may be effective, they do not necessarily prevent overruns of a supply spool caused by tightening of the ribbon on its hub, and they require provisions of extra and relatively expensive parts.

SUMMARY OF THE INVENTION

The present invention provides for a ribbon cartridge of the type that may be used in a powered typewriter or the like, which cartridge includes the improvement of a tensioning and locking apparatus between the ribbon supply and its exit from the cartridge which includes a mechanically biased movable member that bears against the ribbon to hold the ribbon outside span in tension and to absorb small overruns of supplied ribbon during normal use and automatically moves so as to releaseably lock the ribbon by sandwiching it between the movable member and at least one fixed element when the supply overruns ribbon toward the exit.

The invention, together with the advantages thereof, may best be understood by reference to the following description taken in connection with the accompanying drawing, in the several figures of which like reference numerals identify like elements.

DETAILED DESCRIPTION

Figure 1:
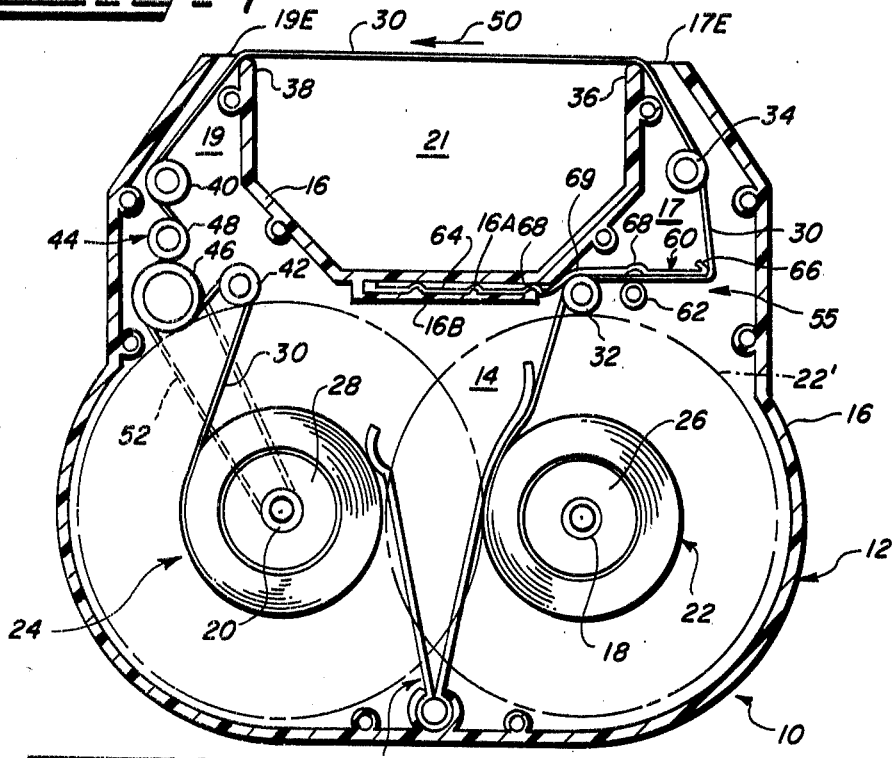
FIG. 1 is a sectional, plan view of a ribbon cartridge constructed in accordance with the principles of the present invention.

Referring to FIG. 1, there is depicted a ribbon cartridge 10 for use with a typewriter and/or printer such as that employed with a word processor, which cartridge is constructed in accordance with the principles of the present invention.

The cartridge 10 includes a housing, generally indicated by the number 12 which is preferably constructed of molded hard plastic. The housing 12 includes sidewalls 16 which may be molded in a unitary manner with a flat bottom wall 14 to extend to a covering upper wall (not shown). A pair of spaced outwardly extending arm portions 17 and 19 are formed integrally as a part of the cartridge housing 12. A gap 21 provided therebetween permits the reception therein of a type element employed in a variety of typewriters and/or printers with which the ribbon cartridge 10 as shown is designed for use. The arms 17, 19 aid in mounting the ribbon 30 onto the ribbon lifter assembly (not shown) employed in such typewriters and printers for raising and lowering the ribbon 30 during printing.

A pair of spindles 18 and 20 (which are part of the typewriter) extend upwardly from the lower wall 14 of the cartridge housing 12 to engage ribbon supply and take up spools 22 and 24, respectively. The ribbon spools 22, 24 each include a central hub such as 26 and 28, mounted on the spindles 18 and 20, respectively, for rotation. The supply spool 22 is wound with ribbon 30 which is to be incrementally transferred therefrom to the takeup spool 24 during the printing process. The ribbon 30 extends from the supply spool 22 about rollers such as 32 and 34, out of the cartridge 10 through arm portion 17, through an exit 17E, over a guide 36, across the gap 21, over a guide 38 formed on arm portion 19, into the cartridge housing 12 through an entrance 19E at the end of arm portion 19, about a roller 40, a drive assembly 44, another roller 42, and onto hub 28 of the takeup spool 24.

The sidewalls 16, upper wall, lower wall 14, and hubs 26, 28 define an enclosed space from which the ribbon 30 leaves at exit 17E and into which it is received at entrance 19E. In use, a printing mechanism (not shown) positioned within gap 21 types or prints through the ribbon 30 to a paper suitably supported on the other side of the ribbon 30 away from gap 21.

The capstan and idler wheel ribbon drive assembly 44 is provided in the housing mounted on the lower wall 14 thereof. The capstan 46 is driven rotatably by cooperating instrumentalities in the typewriter or printer to which the capstan 46 is coupled upon installation of the cartridge 10 in the printer. The ribbon 30 passes between the capstan 46 and idler wheel 48 and is held tightly thereby so that upon rotation of the capstan 46, the ribbon 30 is moved in the direction of arrow 50.

As the ribbon 30 is driven incrementally by the capstan 46, the ribbon 30 is transferred from supply spool 22 to makeup spool 24. The particular ribbon 30 is of the type which passes only once between the supply and takeup spools 22, 24 during use. Thereafter, the cartridge 10 is discarded. This type of ribbon 30 is referred to as a single pass ribbon.

A slip drive belt 52 shown in dotted lines is provided to insure the rotation of the takeup spool 24 during the transfer of the ribbon 30. As the capstan 46 is rotated to drive the ribbon 30, the belt 52 rotates the hub 28 on spindle 20. The belt 52 is permitted to slip because as additional ribbon 30 is wound onto the take-up spool 24 the amount of movement required by the spool 24 to accept the length of ribbon 30 transferred by the rotation of the capstan 46 changes. Thus, if the belt 52 slips, no spilling or breakage of the ribbon 30 occurs because of under or over driving of the spool 24.

To provide a uniform tension on the ribbon 30 throughout its movement between the supply spool 22 and takeup spool 24, regardless of the amount of ribbon 30 present on either spool 22, 24, there is provided the ribbon tensioning device 54. This type of tensioning device is described in detail and claimed in the aforementioned U.S. Pat. No. 4,013,160, and reference may be had to that patent for a fuller description.

In accordance with the present invention, ribbon tensioning and locking apparatus 55 is provided astride the path of the ribbon 30 between the supply spool 22 and the exit 17E. The apparatus 55 includes a member 60. The ribbon 30 passes around one end of the member 60, between that member 60 and a post 62. The member 60 is secured at one end 64 to the interior of sidewall 16, at the area 16A by being sandwiched between the interior of the sidewall area 16A and a second parallel wall section 16B.

The member 60 extends in a cantilever fashion from the end of wall 16B and in normal use is, as shown in FIG. 1, more or less straight, and has the ribbon 30 turning about its free end 66 at about a right angle.

The member 60 is mechanically biased by being made of spring steel or other acceptable spring material and, serves in normal use, to absorb small overruns and to properly tension the span of the ribbon 30 that bridges the gap 21 between the exit 17E and entrance 19E. That is, as the ribbon drive 44 starts up the spring 60 deflects upward to absorb the takeup of ribbon 30 until the inertia of the spool 22 can be overcome. Similarly, upon stoppage of the intermittent drive 44, the spring 60 relaxes somewhat to take up any small overrun caused by the inertia of the moving spool 22.

Figure 2:
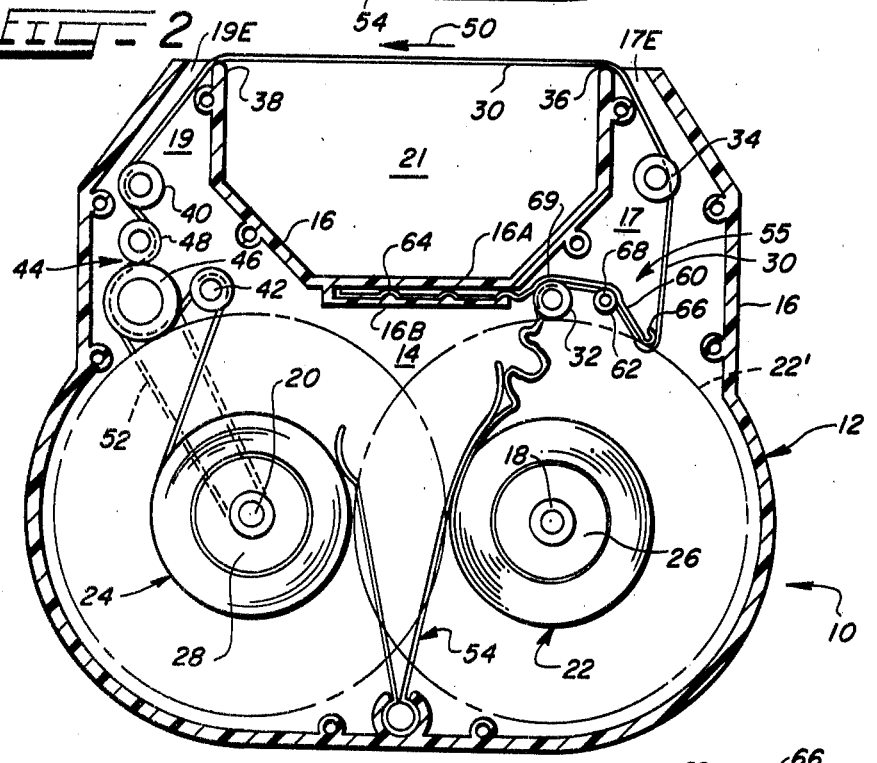
FIG. 2 is a view similar to that of FIG. 1, showing parts of the cartridge of FIG. 1 in moved position.

In the case of unusual overrun, as for example might occur because of vibration in a high speed machine during carriage return or spacing (during which time the drive mechanism 44 keeps the ribbon 30 around it stationary), the spring member 60 relaxes more due to the continued unwinding of ribbon 30 from the supply spool 22 and clamps and sandwiches the ribbon 30 between itself and the post 62, as shown in FIG. 2. For this purpose, the member 60 is provided with a permanent bend or bight 68 which when in the position of FIG. 2, conforms to the shape of the post 62.

Figure 3:
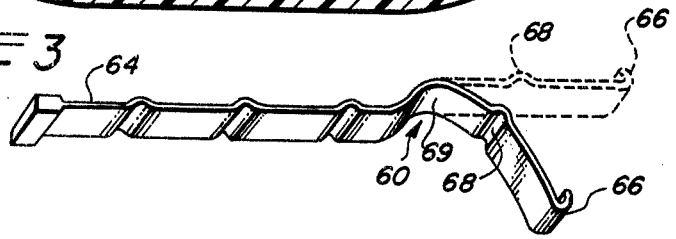
FIG. 3 is a perspective view of one part of the cartridge of FIGS. 1 and 2 with a moved position shown in phantom outline.

The member 60 is arcuately shaped at 69 (as can be seen from FIGS. 2 and 3) to conform to the periphery of roller 32 so that in the usual operating position there is clearance between the member portion 69 and the roller 32. That assures that the bend 68 of the member 60 is free to be urged against post 62 and clamp the sandwiched ribbon 30 or tape.

Further, it should be noted that the end 66 of the member 60 in its relaxed state (FIG. 2) lies within the outer boundary 22' of the fully wound supply spool 22 and thus, also serves to bear against and clamp the unused ribbon 30 against the spool 22 to even more securely hold the ribbon 30 in place. This aids in preventing unwanted unraveling of the ribbon 30 from the supply spool 22 during shipping and handling prior to use on a typewriter or the like. When normal operating conditions are resumed and the ribbon drive 44 becomes active, the preset tension of the spring member 60 meters out the correct amount of ribbon 30 to maintain proper tension until all of the unwound material is used up causing the spool 22 tensioning device 54 to operate and the spring member 60 to assume the normal deflected position of FIG. 1.

It should be noted that the passage from one state to the other is achieved smoothly and without any interruption or outside interference.

It should now be apparent that a novel ribbon cartridge 10 with improved tensioning and locking provision has been described and depicted. The tensioning and locking features of the invention employs a single moving part, the mechanically biased member 60, and yet achieves a positive and continuous and automatic function of tensioning and locking of the ribbon 30 against overrun. Thus, it provides the advantages of ease of operation and assembly, as well as economy of parts and simplicity with the inherent savings in maintenence and repair that result therefrom.

While one particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

What is claimed is:

1. In a ribbon cartridge for use in a typewriter, printer, and the like, comprising a housing having an exit and an entrance mounted therein, a ribbon supply spool and a takeup spool, a length of ribbon mounted on said supply spool and extending therefrom along a predetermined path out of the exit of said housing and back into the entrance of said housing to said takeup spool and a ribbon driving assembly, said driving assembly being drivable incrementally to transfer said ribbon from said supply spool to said takeup spool, the improvement comprising: a spring member having a fixed end and a free end which member positioned adjacent to the predetermined path of the ribbon between the supply spool and the exit from the housing and which spring member is movable from a rest position wherein said spring member bears against the ribbon along a length thereof to captivate the ribbon and prevent the ribbon from moving toward the exit, to a range of energized positions wherein the ribbon passes around said spring member's free end and said spring member serves to tension the ribbon, said spring member being such that a normal drive force applied to the ribbon will move said spring member from its rest position to its energized position but an overrun of ribbon from the supply spool will result in the return of said spring member to the locked position and wherein said spring member is preformed to conform in its rest position to a fixed roller and a fixed post such that the ribbon is sandwiched between said member and said post.

2. The invention of claim 1 wherein the free end of the member also clamps the ribbon against a full supply spool to aid in securing the supply spool during storage and shipping.

* * * * *